US006562767B1

(12) United States Patent
Bachmann et al.

(10) Patent No.: US 6,562,767 B1
(45) **Date of Patent: *May 13, 2003**

(54) PROCESS FOR PRODUCING A LUBRICANT COATED LAQUERED WIRE USED FOR FORMING THE STATOR WINDING OF AN ELECTRICAL REFRIGERATING COMPRESSOR

(75) Inventors: Jürgen Bachmann, Sønderborg (DK); Lars L. Finsen, Nordborg (DK); Poul Erik Hansen, Sydals (DK)

(73) Assignee: Danfoss Compressors GmbH, Flensburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1420 days.

(21) Appl. No.: 08/599,668

(22) Filed: Feb. 12, 1996

Related U.S. Application Data

(63) Continuation of application No. 08/211,045, filed on Mar. 11, 1994, now abandoned.
(60) Provisional application No. PCT/DK92/00284, filed on Sep. 28, 1993, now abandoned.

(30) Foreign Application Priority Data

Sep. 30, 1991 (DK) ..... 1664/91

(51) Int. Cl.[7] ..... C10M 105/00; C10N 40/30
(52) U.S. Cl. ..... 508/463; 508/263; 508/268; 508/305; 508/307; 508/464; 508/496; 508/551; 508/583; 427/118; 428/375; 252/68
(58) Field of Search ..... 252/51.5 A, 52 R, 252/68; 508/168, 305, 307, 263, 268, 464, 469, 583, 244, 463, 496; 427/118; 428/375

(56) References Cited

U.S. PATENT DOCUMENTS 2,161,615 A * 6/1939 Dietrich ..... 508/464
2,187,742 A * 1/1940 Johnson ..... 508/464
2,645,614 A * 7/1953 Holmes ..... 508/591
2,694,014 A * 11/1954 Capell et al. ..... 508/305
2,736,700 A * 2/1956 Graham Jr., et al. ..... 508/168
2,842,837 A * 7/1958 Huet et al. ..... 508/168
2,899,390 A * 8/1959 Plemich ..... 508/591
3,301,784 A * 1/1967 Anderson ..... 508/268
3,312,620 A * 4/1967 Low et al. ..... 252/51.5 A
3,340,194 A * 9/1967 Rue et al. ..... 252/56 R
3,758,514 A * 9/1973 Heiba et al. ..... 508/305
3,770,636 A * 11/1973 McDole ..... 508/591
3,791,975 A * 2/1974 Halkias ..... 508/463
4,204,481 A * 5/1980 Malec ..... 123/1 A
4,280,916 A * 7/1981 Richards et al. ..... 252/51.5 A
4,350,737 A * 9/1982 Saunders et al. ..... 428/383
4,362,861 A * 12/1982 Shen ..... 528/289
4,410,419 A * 10/1983 Ferm ..... 252/51.5 A
4,420,536 A * 12/1983 Saunders et al. ..... 428/383
4,605,710 A * 8/1986 Guilbert ..... 528/438
4,687,587 A * 8/1987 Daglish et al. ..... 508/591
4,938,887 A * 7/1990 Grava et al. ..... 508/268
5,420,185 A * 5/1995 Watanabe et al. ..... 524/210

* cited by examiner

*Primary Examiner*—Margaret Medley
(74) *Attorney, Agent, or Firm*—Barnes & Thornburg

(57) ABSTRACT

A lubricant for wire, which is insulated by means of a lacquer coating, and which is used for forming the stator windings of an electrical refrigerating compressor, consists of one or more compounds of the formula $CH_3—X_n—R$, wherein X is a linear or branched hydrocarbon group with n carbon atoms, wherein n is up to 22, and R may be hydrogen or a plurality of different radicals, either in a pure form or dissolved in a suitable solvent. The lubricant is applied to the wire to reduce its coefficient of friction, and it is remarkable for its compatibility with the environmentally unharmful refrigerants, such as R134a (1,1,1,2-tetrafluoroethane), which are used today in refrigerating compressors without capillary tube obstructions.

11 Claims, No Drawings

PROCESS FOR PRODUCING A LUBRICANT COATED LAQUERED WIRE USED FOR FORMING THE STATOR WINDING OF AN ELECTRICAL REFRIGERATING COMPRESSOR

This application is a continuation of application Ser. No. 08/211,045, filed Mar. 11, 1994, now abandoned.

The present invention concerns a lubricant for wire which is used for forming the stator windings of an electrical refrigerating compressor. The wire consists of a conductor coated with an electrically insulating layer on which a lubricant is applied to reduce the coefficient of friction of the wire. Of course, such a lubricant must have the lubricating properties necessary for the intended use, but must moreover be compatible with the refrigerant used in the refrigerating compressor.

It is known from the DE Offenlegungsschrift 1947071 and the GB Patent Specifications 1175059 and 1175060 to provide electrical cables with lubricants for the purpose of reducing the mutual friction between the cables. When such a lubricant is added to the insulating layer around the conductor, a single cable among many cables, e.g. telephone cables in the same pipe can readily be removed or introduced, because the coefficient of friction of the individual cables is reduced considerably.

The preferred lubricant added to the insulating layer of polyolefin according to the above-mentioned documents is an amide which is added in various amounts and using various additives to the insulating layer before this layer is applied around the conductor.

The U.S. Pat. Nos. 4,348,460, 4,350,737, 4,350,738, 4,385,436, 4,385,437, 4,390,590, 4,410,592 and 4,449,290 separately concern lubricants for wire which is used for forming the stator windings of electrical motors. These patent specifications describe the general problems which are associated with automatic mounting of the stator windings, including the importance of the wires having a suitably low coefficient of friction. This is necessary to avoid mechanical damage to the wires, e.g. by rubbing, by mounting in the slots in the stator.

The patent specifications also describe how the lubricant used for the wires may cause problems in connection with refrigerating compressors, because the lubricant precipitates from the solution when this contacts the refrigerant used in the refrigerating system. The precipitated lubricant will hereby be moved about in the refrigerating system, which involves capillary tube obstructions. This is obviated according to the above-mentioned US patent specifications by completely removing the lubricant by heating following mounting of the windings.

The lubricants used according to the above-mentioned US patent specifications may be mixtures of paraffin wax, triglycerides and esters having a lubricating effect. Such a mixture is added by moving the wire, which has been provided with an insulating layer beforehand, across two pieces of felt which are dipped in the mixture. The lubricants may moreover be bees' wax which is applied to various types of insulation layers, such as nylon or I polyamide imide, optionally in mixture with oleic acid and surfactants.

It is moreover known that paraffin may be used as a lubricant for wire in connection with the manufacture of electrical refrigerating compressors. This lubricant is excellent in its present form in connection with the classic refrigerant R12 (Freon®12), dichlorodifluoro-methane $CCl_2F_2$). However, this refrigerant has been found to deplete the ozone layer in the atmosphere, and its use will therefore be banned (in all EEC countries as from Jan. 1, 1997). Instead of R12 less environmentally harmful refrigerants will be used, primarily the refrigerant R134a (1,1,1,2-tetrafluoroethane $CF_3CH_2F$), alone or in mixture with other refrigerants.

However, it has been found that the paraffin used till now is not soluble in the refrigerant R134a, but, on the contrary, precipitates when the temperature drops. This results in capillary tube obstructions.

When it is known beforehand that precipitation of the lubricant will take place, capillary tube obstructions can be avoided by removing the lubricant after mounting of the wound wires, as described e.g. in the above-mentioned U.S. Pat. No. 4,350,737. However, such a removal is a process adding to the costs and for the used lubricant to be removed completely it is often necessary to use cleaning agents which are harmful to the environment.

Conclusively, a lubricant for the wire in a refrigerating compressor is to satisfy the following requirements: (1) It is to give such a small coefficient of friction that the wire will not be mechanically damaged during winding and mounting, and (2) it must not be capable of releasing substances that can damage the refrigerating system or the compressor. Finally, (3) it must possible to add to it a solvent which is environmentally unharmful.

The DE Auslegeschrift 1011109 and the EP Patent Application 0445611 disclose dialkyl esters of di- or polycarboxylic acids, which maybe used as lubricants, and which, as regards some of them, are soluble in e.g. the refrigerant R134a. However, these lubricants are exclusively used for lubricating the movable mechanical parts in the compressor in operation, and, usually, the lubricants are present in a lubricating sump in the compressor, from which they might be circulated through the cooling system and should therefore be soluble in the refrigerant used.

The lubricant of the invention, however, is not a lubricant in the above-mentioned sense, but, in contrast, is an agent to be applied to the wire, which is used for forming the stator windings in a refrigerating compressor. As mentioned above, to be useful for this purpose, the lubricants must satisfy three requirements, which must be met simultaneously, which is not the case with the lubricants known from the above-mentioned DE Auslegeschrift and EP Patent Application.

It has now surprisingly been found that a group of compounds are active as lubricants capable of satisfying the above-mentioned requirements, and that these compounds are compatible with the new refrigerants which spare the ozone layer.

Thus, the invention concerns a lubricant for wire which is used for forming the stator windings of an electrical refrigerating compressor, said wire being coated with an electrically insulating layer, and the lubricant of the invention is characterized in that it consists of one or more compounds of the general formula $$CH_3—X_n—R$$

wherein X is a linear or branched hydrocarbon group with n carbon atoms and optionally containing one or more double bonds, and R is (a) hydrogen, in which case n is 16–22;

(b) —COOR, wherein $R^1$ is $C_1$–$C_4$ alkyl, in which case n is 15–19;

(c) —OOC—$R^2$—COO$R^3$, wherein $R^2$ is $C_8$–$C_{10}$ alkyl and $R^3$ is $C_1$–$C_4$ alkyl, in which case n is 0–3;

(d)

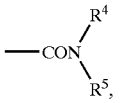

wherein $R^4$ and $R^5$ are separately hydrogen or $C_1$–$C_2$ alkyl, in which case n is 12–18;

(e)

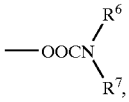

wherein $R^6$ and $R^7$ are separately hydrogen or $C_4$–$C_8$ alkyl, in which case n is 0–3;

(f) a group of the formula

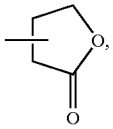

in which case n is 8–14;

(g) a group of the formula

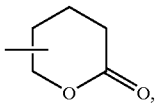

in which case n is 8–14;

(h) a group of the formula

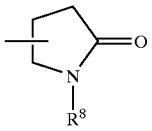

wherein $R^8$ is hydrogen or $C_1$–$C_2$ alkyl, in which case n is 6–11 or (i) a group of the formula

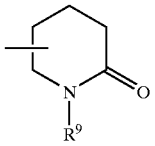

wherein $R^9$ is hydrogen or $C_1$–$C_2$ alkyl, in which case n is 1–5, either in pure form or dissolved in a suitable solvent.

Useful solvents are e.g. test petrol, butanol, propanol and ethanol.

The use of the present lubricants firstly provides extremely good lubricating properties, and secondly problems of capillary tube obstructions are avoided because the lubricants are compatible with the new environmentally unharmful polar refrigerants, such as the above-mentioned R134a ($CF_3CH_2F$) and R124 ($CHClFCF_3$), R125 ($CHF_2CF_3$), R152a ($CHF_2CH_3$) as well as mixtures thereof. Consequently, it is not necessary either to remove the lubricant from the wire after completed winding.

In connection with the present invention no requirements are made of the wire used beyond the requirements generally made of wire to be used for forming stator windings in an electrical refrigerating compressor. The insulating layer surrounding the wire is typically a lacquer, which is just to satisfy the requirements that it is to be compatible with and resistant to the refrigerant used, and that it is to be heat- and cold-resistant.

The lacquer may e.g. a polyester imide which is suitably modified with tris-hydroxyethyl isocyanurate (THEIC) for the purpose of making the lacquer resistant to the refrigerant. The lacquer may also be of the two-layer type which consists of a primer of a polyester imide with a top coat of a polyamide imide.

The coefficient of friction of the wire after application of the lubricant is measured according to the standard DIN 46453, and values of below 0.15 are required to satisfy the requirement with respect to avoiding damage during winding and mounting of the stator.

The compounds of the formula shown above may be a plurality of different chemical compounds, more particularly paraffins, esters of carboxylic acids, diesters of dicarboxylic acids, amides of carboxylic acids, urethanes (carbamates), derivatives of γ- and δ-lactams and derivatives of γ- and δ-lactones.

The invention will be illustrated more fully by the following examples:

EXAMPLE 1

The lubricant is a paraffin which consists of a mixture of alkanes having the chain length 18 to 20 carbon atoms and has the formula:

$$CH_3(CH_2)_{16\text{-}18}CH_3$$

The solubility of the paraffin, melting in the range 29–33° C., with respect to the refrigerant R134A is evaluated by means of the method according to the standard DIN 51 331. It has been found that 50 mg can be dissolved in 100 g of R134a down to −45° C. 50 g of the paraffin are dissolved in 15 liters of petrol (boiling point 110–130° C.), and the solution is applied to a wire coated with lacquer of the polyester imide type suitably modified with THEIC. Application is performed by means of pieces of felt. After evaporation of the petrol, coefficients of friction of 0.14–0.15 sufficiently low to prevent mechanical damage to the wire are obtained.

EXAMPLE 2

The lubricant is stearic acid methyl ester of the formula $$CH_3(CH_2)_{16}COOCH_3$$

dissolved in ethanol. It has been found that 50 mg of the ester can be dissolved in 100 g of R134a down to −45° C., which is the necessary amount in a motor. 10 g of stearic acid methyl ester are dissolved in 15 liters of ethanol, and the solution is applied to a wire coated with lacquer of the polyester imide type suitably modified with THEIC. Application is performed by means of pieces of felt. After the ethanol has evaporated, coefficients of friction of 0.14–0.15 sufficiently low to prevent mechanical damage to the wire are obtained.

EXAMPLE 3

The lubricant is azelaic acid dibutyl ester of the formula $$C_4H_7—OOC(CH_2)_7COO—C_4H_7$$

whose solubility with respect to the refrigerant R134a is evaluated by means of the method according to the standard DIN 51 311. It has been found that 100 mg can be dissolved in 100 g of R134a down to −45° C. 120 g of the diester are dissolved in 15 liters of ethanol, and the solution is applied to a wire coated with lacquer of the polyester imide type suitably modified with THEIC. Application is performed by means of pieces of felt. After evaporation of the ethanol, coefficients of friction of 0.14–0.15 sufficiently low to prevent mechanical damage to the wire are obtained.

EXAMPLE 4

The lubricant is a carboxylic acid amide of the formula $$CH_3—(CH_2)_{15}—\overset{\overset{\displaystyle O}{\|}}{C}—NH^2$$

whose solubility with respect to the refrigerant R134a is evaluated by means of the method according the standard DIN 51 331. It has been found that 100 mg can be dissolved in 100 g of R134a down to −45° C. 120 g of the carboxyl amide are dissolved in 15 liters of ethanol, and the solution is applied to a wire coated with lacquer of the polyester imide type suitably modified with THEIC. Application is performed by means of pieces of felt. After evaporation of the ethanol, coefficients of friction of 0.14–0.15 sufficiently low to prevent mechanical damage to the wire are obtained.

EXAMPLE 5

The lubricant is N,N-dimethylpentyl carbamate of the formula $$(CH_3)_2NCOOC_5H_{11}$$

whose solubility with respect to the refrigerant R134a is evaluated by means of the method according to the standard DIN 51 331. It has been found that 150 mg can be dissolved in 100 g of R134a down to −45° C. 120 g of the carbamate are dissolved in 15 liters of ethanol, and the solution is applied to a wire coated with lacquer of the polyester imide type suitably modified with THEIC. Application is performed by means of pieces of felt. After evaporation of the ethanol, coefficients of friction of 0.14–0.15 sufficiently low to prevent mechanical damage to the wire are obtained.

EXAMPLE 6

The lubricant is palmitic acid methyl ester of the formula $$CH_3(CH_2)_{14}COOCH_3$$

dissolved in ethanol. It has been found that 50 mg of the ester can be dissolved in 100 g of R134a down to −55° C. 10 g of palmitic acid methyl ester are dissolved in 15 liters of ethanol, and the solution is applied to a wire coated with lacquer of the polyester imide type suitably modified with THEIC. Application is performed by means of pieces of felt. After the ethanol has evaporated, coefficients of friction of 0.14–0.15 sufficiently low to prevent mechanical damage to the wire are obtained.

What is claimed is:

1. A process for forming a wire in the stator windings of an electrical refrigerating compressor using a refrigerant comprising the steps of:

(1) coating said wire with an electrically insulating layer compatible with and resistant to said refrigerant;

(2) coating said electrically insulating layer with a lubricant to give it a low coefficient of friction so that said wire will not be mechanically damaged during winding and rewinding;

(3) winding and mounting said wire in said stator windings; and (4) after winding and mounting said wire in said stator windings, preventing damage to the refrigerating system or the compressor by exposing said lubricant to a compatible refrigerant/refrigeration system.

2. A process for forming a wire according to claim 1 wherein said lubricant consists of at least one compound of the general formula $$CH_3—X_n—R$$

wherein X is a linear or branched hydrocarbon group with n carbon atoms and optionally containing one or more double bonds, and R is selected from the group consisting of (a) hydrogen, in which case n is 16–22;

(b) $—COOR^1$, wherein $R^1$ is $C_1$–$C_4$ alkyl, in which case n is 14–19;

(c) $—OOC—R^2—COOR^3$, wherein $R^2$ is $C_7$–$C_{10}$ alkyl and $R^3$ is $C_1$–$C_4$ alkyl, in which case n is 0–3;

(d)

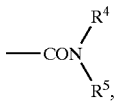

wherein $R^4$ and $R^5$ are separately hydrogen or $C_1$–$C_2$ alkyl, in which case n is 12–18;

(e)

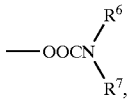

wherein $R^6$ and $R^7$ are separately hydrogen or $C_4$–$C_8$ alkyl, in which case n is 0–3;

(f) a group of the formula

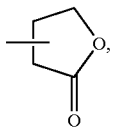

in which case n is 8–14;

(g) a group of the formula

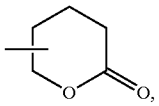

in which case n is 8–14;

(h) a group of the formula

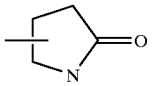

wherein $R^8$ is hydrogen or $C_1$–$C_2$ alkyl, in which case n is 6–11 or (i) a group of the formula

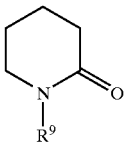

wherein $R^9$ is hydrogen or $C_1$–$C_2$ alkyl, in which case n is 1–5.

3. A process for forming a coated wire according to claim 2, in which the lubricant is applied to the wire by means of pieces of cotton or felt.

4. A process according to claim 2, in which said lubricant is further dissolved in a solvent and said solvent is selected from the group consisting of petrol, butanol, ethanol and propanol.

5. A process according to claim 2 in which the lubricant is a carboxylic acid amide of the general formula $$CH_3—X_n—\overset{\overset{\displaystyle O}{\|}}{C}—NR^4R^5$$

wherein $X_n$, $R^4$ and $R^5$ are as defined in claim 2.

6. A process according to claim 5, in which $X_n$ is $—(CH_2)_{15}—$, and $R^4$ and $R^5$ are hydrogen.

7. A process according to claim 2, in which the lubricant is a carboxylic acid alkyl ester of the general formula $$CH_3—X_n—COOR^1$$

wherein $X_n$ and $R^1$ are as defined in claim 2.

8. A process according to claim 7, in which $X_n$ is $—(CH_2)_{16}—$, and $R^1$ is methyl.

9. A process according to claim 7, in which $X_n$ is $—(CH_2)_{14}—$, and $R^1$ is methyl.

10. A process according to claim 4 including ethanol used as a solvent in which said amide is further dissolved in ethanol as a solvent.

11. A process according to claim 4 wherein ethanol is used as a solvent in which said ester is further dissolved.

* * * * *